United States Patent [19]

Shay

[11] 4,007,858

[45] Feb. 15, 1977

[54] SQUEEZE-BOTTLE-TYPE POWDER DISPENSER

[75] Inventor: Joseph John Shay, Manchester, N.H.

[73] Assignee: Summit Packaging Systems, Inc., Manchester, N.H.

[22] Filed: Feb. 17, 1976

[21] Appl. No.: 658,587

[52] U.S. Cl. ..... 222/193; 302/57

[51] Int. Cl.[2] ..... B67D 5/54; B05B 11/04

[58] Field of Search ..... 222/193, 211; 302/50, 302/51, 57

[56] References Cited

UNITED STATES PATENTS 2,450,205 9/1948 Rose ..... 222/193

*Primary Examiner*—Allen N. Knowles
*Assistant Examiner*—Hadd Lane
*Attorney, Agent, or Firm*—Dallett Hoopes

[57] ABSTRACT

Plastic squeeze bottle is provided with discharge tube as well as down tube extending from above the powder level to the lower end of the discharge tube. Baffle is disposed at the lower end of the two tubes. During dispensing, squeeze of the bottle increases air pressure above the powder which drives air down through the powder and drives air down down tube to fluidize powder on the baffle from whence it moves upward through discharge tube to discharge.

12 Claims, 13 Drawing Figures

SQUEEZE-BOTTLE-TYPE POWDER DISPENSER

BACKGROUND OF THE INVENTION

1. Field of the Invention

This invention relates to powder dispensers of the squeeze-bottle-type. More specifically, this invention relates to a squeeze bottle powder dispenser with special means to help fluidize the powder and move it as a uniform air-powder suspension toward and out the discharge opening.

2. Description of the Prior Art

Squeeze-bottle powder dispensers have been used with foot and body powders, with insecticides, and a host of other products.

In the prior art, it has been customary to provide powder dispensers of the squeeze-bottle-type with simple nozzles in their upper end. Operation has been based on the general proposition that the pressure of air behind the powder will drive out an amount of powder for each squeeze of the bottle. Dispensers of this type, however, have delivered powder unevenly because of the inadequate powder fluidization. Clumps of powder have discharged: the nozzles have clogged. In short, the prior dispensers have not promoted the uniform suspension of powder particles desired by consumers of powder products.

There are in the prior art showings of powder dispensers in which a squeeze bulb has delivered air to the powder container at a point well down in the powder supply and a discharge tube has delivered powder from adjacent the air delivery point up to discharge. Examples are U.S. Pat. No. 2,202,079, issued May 28, 1940 to Ayres and U.S. Pat. No. 2,358,329, issued Sept. 19, 1944 to Houghton.

In neither of the above examples, however, has pressure been developed above the supply of powder not only to drive air down through a tube to a point near the lower end of a discharge tube, but also to in effect force air down through the powder to carry powder into the lower end of the discharge tube. Further, there has been no structure designed to direct the flow of air adjacent the lower end of the discharge tube and control the admixture of powder. Moreover, in the earlier examples there have been no employment of the increased height of the powder level due to the narrowing of the squeeze bottle in squeezing to facilitate introduction of powder into the discharge tube. The earlier examples have merely relied on the pressure-generating means, usually an independent squeeze bulb, to aspirate powder up the discharge tube to a discharge orifice.

SUMMARY OF THE INVENTION

Under the present invention, there is provided a squeeze bottle having a discharge tube and a down tube adapted to conduct pressure from the space above the powder supply down to the entrance to the discharge tube. Additionally, the invention provides a baffle at the lower end of the container to assist in the metering and fluidization of the powder. This fluidization establishes a uniform mixture with air for movement out of the dispenser.

By means of the present invention, it is possible by the design of the baffle and cross section of the discharge tube and down tube to control the velocity of the air stream and thus the ratio of air to powder in the discharge stream.

The implications of the present invention will be readily understood by those skilled in the art. Inherent in the uniform fluidization of the powder is the entrainment in the air discharge stream of a uniform distribution of particle size resulting in a uniform delivery of powder mixtures. This is important in those cases in which the powder comprises more than one ingredient. Further, ability to control the velocity of the air stream means that the dispenser can be tailored to dispense a given powder at a desired rate, taking into consideration whether the powder is more or less dense, whether it is of predominantly large or small particle size, and whether it is a single ingredient, or a blend of ingredients.

Moreover, the control of the ratio of air to powder in the discharge stream permits the selection of a desired one of a limitless number of discharge orifices and discharge head configurations.

BRIEF DESCRIPTION OF THE DRAWINGS

Further objects and features of the invention will be apparent from a reading of the following specification and a study of the attached drawings, all of which disclose non-limiting embodiments of the invention. In the drawings.

DESCRIPTION OF THE PREFERRED EMBODIMENTS

Figure 1:
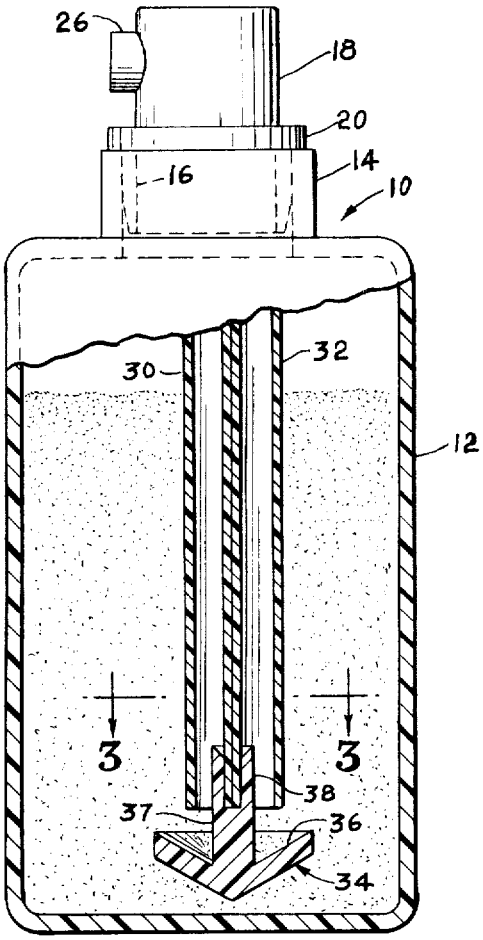
FIG. 1 is a side elevational view, partly in section, showing an embodiment of the invention.

A squeeze bottle embodying the invention is generally designated 10 in FIG. 1. It comprises a container 12 of plastic, for instance, polyethylene, which has been blow-molded to present a neck 14.

Figure 2:
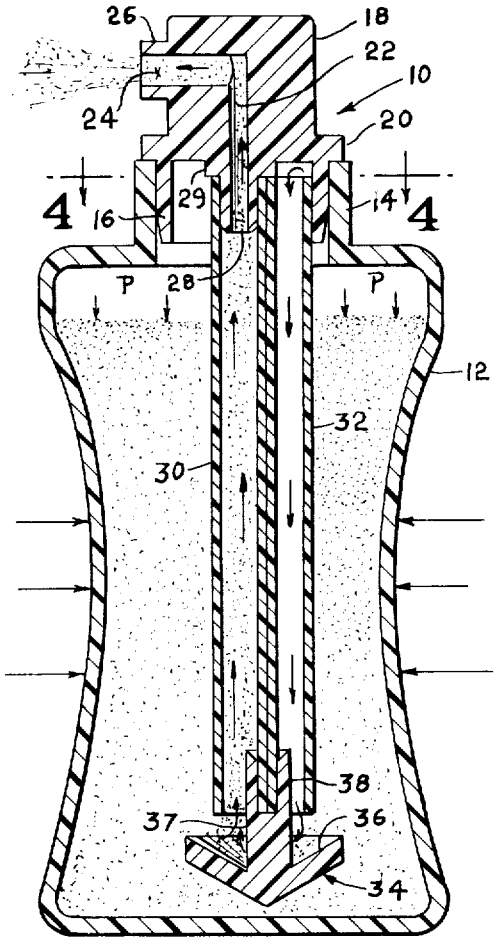
FIG. 2 is a sectional view similar to FIG. 1 but showing the squeeze bottle squeezed, as in a dispensing operation, promoting the fluidization and flow of powder from inside the bottle to outside the bottle.
Figure 3:
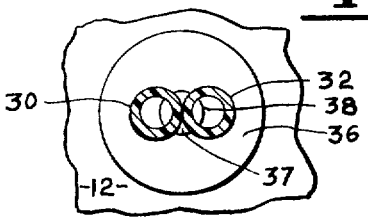
FIG. 3 is a sectional view taken on the line 3—3 of FIG. 1.
Figure 4:
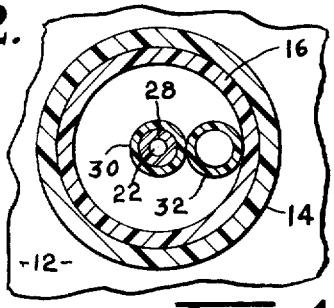
FIG. 4 is a sectional view taken on the line 4—4 of FIG. 2.

Fitting inside the neck 14 is the downward flange 16 of a dispensing head 18. The head also includes a stop shoulder 20 which abuts the top of the neck 14. As shown in FIG. 2, the head is formed with an axial passage 22 with a right angular discharge port 24 terminating in a short snout 26.

The lower end of the head is provided as shown in FIG. 2, with a nipple 28 circumposed by a shoulder 29. A plastic discharge or dip tube 30 fits over the nipple up to the shoulder and communicates with the discharge passage 22 at the lower end of the nipple thereof. Extruded integrally with the dip tube 30 is the down tube 32 which is parallel thereto but independent thereof except that the two tubes are coextensive; that is, the upper and lower ends thereof terminate at the same points.

It will be understood that the presence of the shoulder 29 limits the upward installation of the tube 32. This permits the upper end of the tube 32 to have some clearance with respect to the underside of the head, as shown.

A baffle 34 is installed at the lower end of the tubes and comprises a dish-shaped element 36 having a central upstanding stud 37 which is bifurcated as at 38. The bifurcations engage the two contiguous portions of the tubes 30 and 32 to thereby support the baffle and properly position it. The stud 37 in effect spaces the dish-shaped element 36 down from the lower end of the tubes 30, 32.

Figure 5:
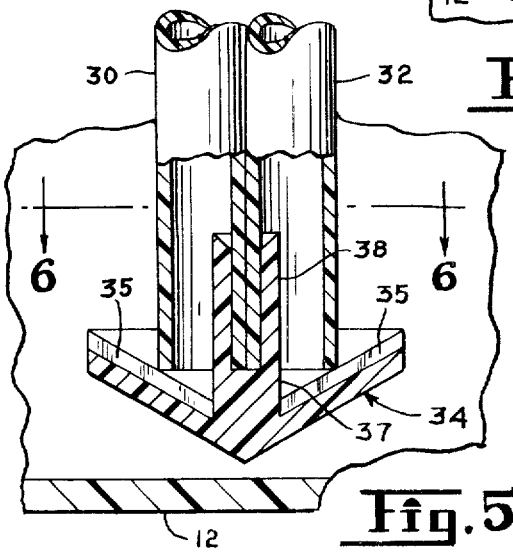
FIG. 5 is a fragmentary view, partly in section, of a modified form of baffle used with the invention.
Figure 6:
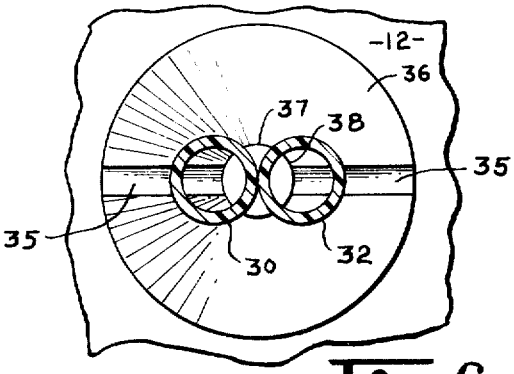
FIG. 6 is a sectional view taken on the line 6—6 of FIG. 5.

Alternatively, the two tubes may, as shown in FIG. 5, be brought down to stop right against the upper surface of the dish-shaped element 36. This permits space thereunder for the powder to fluidize, as will be explained. Radial grooves in the upper surface of the dish-shaped element as at 35 assures some passage of powder no matter what the radial orientation of the two tubes with respect to the baffle.

The operation of the powder dispenser shown in FIGS. 1 through 6 is easily understood. A squeeze of the resilient walls of the container as shown in FIG. 2 will narrow the interior of the container and create a positive air pressure at the area P above the level of the powder. This pressure will exist in the neck 14 of the dispensing head and air will move downward through tube 32 and at the dish-shaped element 36. This blast of air will result in the fluidization of the powder resting on the baffle. Presence of lower pressure approaching atmospheric at the lower end of the dip tube 30 causes the fluidized powder and a large volume of air to move upward through the tube 30, through the passage 22 and out orifice 24.

Additionally, the pressure created at P presses downwardly through the powder as indicated by arrows and moves the powder into the space between the element 36 and the lower end of the tubes 30, 32. This movement is additionally assisted by the fact that the squeezing of the walls presses powder inward onto the baffle. The squeezing also reduces volume in the container and causes an upward shift of the powder level (cf FIG. 1) creating a somewhat higher powder pressure (comparable to increased hydrostatic head) at the area of the baffle tending also to move the powder into the baffle.

A variation of the invention is shown in FIGS. 7 through 13. In this version, the primed form of the same reference numerals is used to designate parts corresponding to the numbered parts in FIG. 1.

Figure 7:
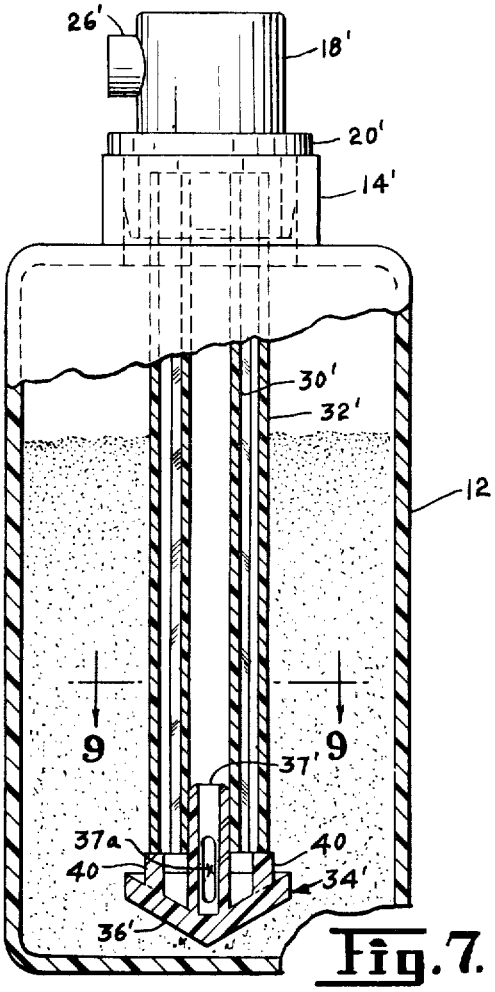
FIG. 7 is a view similar to FIG. 1 but showing a modified form of discharge tube arrangement and a modified baffle.
Figure 8:
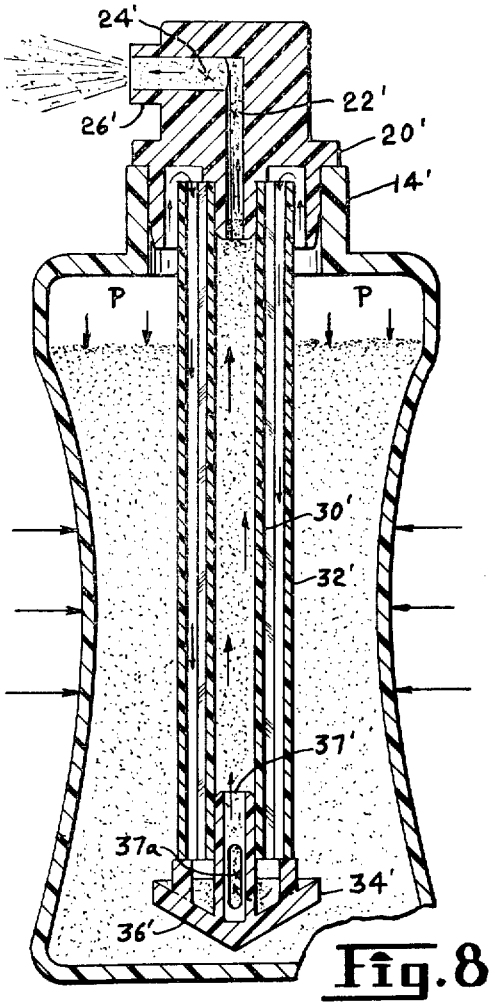
FIG. 8 is comparable to FIG. 7 but shows the walls of the container collapsed inward as during a dispensing operation.
Figure 9:
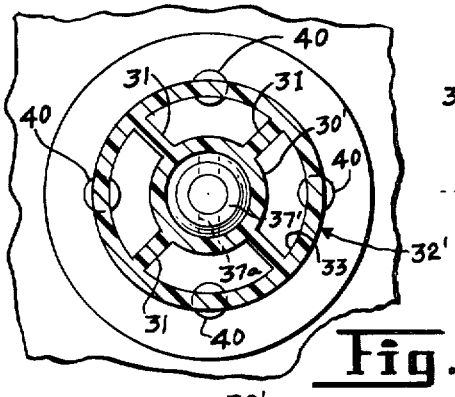
FIG. 9 is a greatly enlarged sectional view taken on the line 9—9 of FIG. 7.

Rather than the double discharge tube-down tube arrangement 30, 32, shown in FIG. 2, the FIGS. 7 through 13 versions present a tube structure in which the discharge or dip tube 30′ is central of a coaxial structure, the annular surrounding conduit defining down tube element 32′. As shown in FIG. 9, the down tube element comprises the wall of the central tube 30′, a plurality of radial webs 31 outward therefrom, and an out circular wall 33.

Secured at the bottom of the discharge tube-down tube arrangement of FIG. 7 is a baffle 34′ comprising the dish-shaped baffle which is equipped with a central upstanding tubular element 37′. This element is provided with windows 37*a* through which the fluidized powder may pass into the dip tube 30′. Preferably, the dish-shaped element may be provided with a plurality of spaced stops 40 to define the distance between the lower end of the tube 30′, 32′ and the dish-shaped element 36′, and to provide a metering means to control the flow of powder into dish-shaped element 36′.

Figure 10:
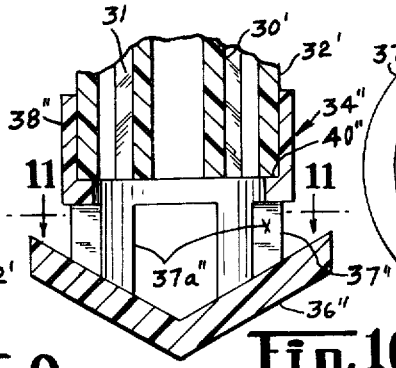
FIG. 10 is a sectional view of a modified form of baffle.
Figure 11:
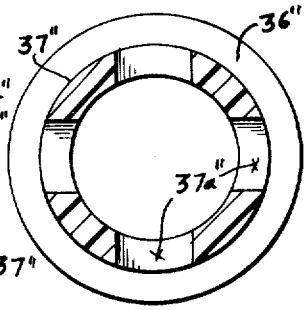
FIG. 11 is a sectional view taken on the line 11—11 of FIG. 10.

The baffle embodiment shown in FIGS. 10 and 11 engages the concentric tube 30′, 32′ externally rather than internally, as shown in FIGS. 7 through 9. The modified baffle 34″ comprises the dish-shaped or inverted cone-shaped body 36″ having an upward tubular support 37″ which is formed with a plurality of peripheral windows 37*a*″ to permit the passage of powder into the area beneath the tube. The tubular support widens as it extends upwardly to present a tube-engaging sleeve 38″ which has a diameter slightly enlarged at the bottom of the tube 32″ to present a stop shoulder 40″. This controls the spacing of the baffle surface 36″ from the bottom of the tube. It will be understood that the spacing may be changed by simply re-dimensioning the distance of the stop 40″ from the baffle surface.

Figure 12:
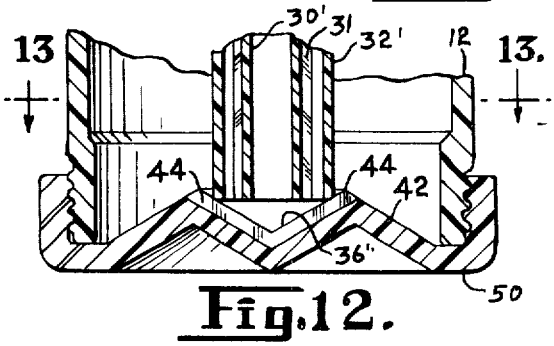
FIG. 12 is a fragmentary sectional view of the lower end of a squeeze bottle embodying the invention showing a modified dispensing tube baffle arrangement.
Figure 13:
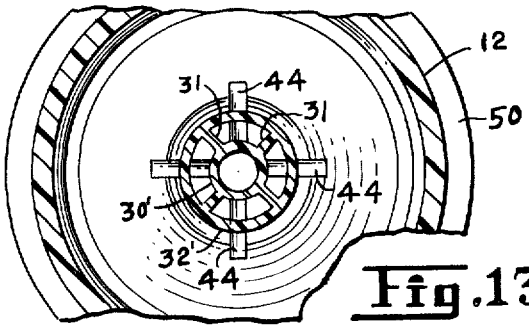
FIG. 13 is a sectional view taken on the line 13—13 of FIG. 12.

In the embodiment shown in FIGS. 12 and 13, the lower end of the container 12 is provided with a removable screw cap 50. This cap is formed with an annular upward ridge 42 defining therein a valley 36″ comparable to the dish-shaped element 36′. This ridge 42 may be formed with a plurality of radial grooves 44, and its upper surface may serve as a stop and centering means for the lower end of the tube 30′, 32′.

The embodiment shown in FIGS. 7 through 13 is very comparable in operation to the earlier described embodiment. Thus, as the bottle is squeezed (FIG. 8), an increased pressure develops above the level of the powder at P. This pressure, seeking relief, moves upward into the head and down through the down tube 32′ in the discharge tube/down tube structure. At the lower end of the down tube, the air blasts at the dished element 36′ and fluidizes powder therein.

From thence the fluidized powder moves in through the windows 37*a* seeking the lower atmospheric pressure at discharge, and up the tube 30′ into passage 22′ and out discharge nozzle 24′. A portion of the air pressure similarly drives down through the body of powder to urge powder into the cavity between the bottom of the down tube 32′ and the dish-shaped element 36′ ready for the next squeeze. Additionally, the build-up of "hydrostatic" head as the sidewalls are collapsed enhances this effect, as explained.

The presence of the baffle 34 serves to assist in the normal filling operation in that the dip tube may be inserted in through the neck 14 and the head moved homeward to the position where the stop 20 abuts at the top of the neck, all without the impaction of powder up the tubes 30, 32 whether those tubes are in the parallel form of the FIGS. 1 through 6 embodiment or the concentric form shown in FIGS. 7 through 13. In other words, the baffle serves as a kind of guide shoving powder to one side as the tube is inserted.

The above-described operation is substantially similar to the operation of the FIGS. 12, 13 structure. Powder moves into valley 36'' and is fluidized by the down blast from tube 32'. Subsequently, it moves up tube 30'. Air pressure through the powder now forces more powder onto the baffle.

The FIG. 12 version is normally filled in the inverted position with the screw cap 50 removed. Once the cap 50 is restored to position, the concentric discharge tube-down tube arrangement abuts against the baffle 42. Passages 44 assure that powder can move between the baffle and the bottom of the tube in a controlled manner.

It will be apparent that the various dimensions of the parts of the structures disclosed may be changed to effect certain results as mentioned above; for instance, the ratio of air to powder in the dispensed suspension may be varied by increasing the diameter of the down tube to achieve a higher ratio. Further, the size, slope, and inlet shape of the baffle may be altered to make more or less powder available to the downcoming blast of air with predictable consequence in the air-powder discharge. Such design ramifications are felt, however, to be within the scope of those skilled in the art and need not be detailed further here.

Modifications are envisioned. For instance, the discharge head may be disposed at the lower end of the container with the baffle a part of it. In such a variation, the "down" tube runs upward from the baffle. Further, the use of the disclosed arrangement in an aerosol-type dispenser is contemplated wherein the propellant is adsorbed onto the particles of the powder and as the dispensing valve is operated, relieveing pressure, the propellant comes off the powder and further pressurizes the zone in the container above the powder supply moving gas downward through a down tube to fluidize powder at the baffle prior to dispensing a dry powder-gas mixture.

There can obviously be structural changes. Examples follow. The discharge and down tubes can be secured directly to the neck of the bottle and the nozzle can snap over the neck. Further, various other dip tube-down tube structures may be employed. Notches or windows may be formed in the bottom of the tubes in place of the channels 35 in the baffle 34 to provide passageway of powder into the tubes. A check valve may be disposed in the down tube to block upward movement of powder when the pressure in the container is reduced after the dispensing squeeze.

Thus, while only various preferred versions of the invention have been disclosed, it should be clear that the invention is capable of many additional variations not disclosed. Therefore, the invention is to be thought of in terms of the following claim language or equivalents thereof.

I claim:

1. A powder dispenser comprising a container adapted to contain powder and having resilient sidewalls and a dispensing head having a discharge orifice therein, first conduit means extending inside the container and communicating from the orifice to a point adjacent the lower end of the container, second conduit means extending inside the container from adjacent said point up to second point adjacent the upper end of the container, and generally horizontal baffle surface means spaced proximately below the lower end of the second conduit means, whereby squeezing the resilient walls of the container instantly pressurizes the upper end of the container to drive air down the second conduit means to mix with powder immediately above the baffle surface means and fluidize the powder, moving the air-powder mixture into and through the first conduit means and out the orifice, the squeezing of the walls moving powder inward toward the baffle and reducing the cross section of the container and driving upward the level of powder to increase the hydrostatic pressure of the powder at the first point and forcing a portion of the air down through the powder to urge powder between the baffle and the lower end of the second conduit.

2. A powder dispenser as claimed in claim 1 wherein the first and second conduit means comprise respectively a pair of coextensive integrally formed side-by-side tubes.

3. A powder dispenser as claimed in claim 1 wherein the first and second conduit means comprise respectively concentric tubes, the second conduit means comprising the annulus between the first and second tube.

4. A powder dispenser as claimed in claim 1 wherein the baffle surface means is dish-shaped.

5. A powder dispenser as claimed in claim 1 wherein the container is a plastic squeeze bottle.

6. A powder dispenser as claimed in claim 1 wherein the discharge orifice is disposed at the upper end of the container.

7. A powder dispenser as claimed in claim 1 wherein the surface means comprises a configuration of the lower surface of the bottom wall of the container.

8. A powder dispenser comprising a container adapted to contain powder and having a dispensing head at the upper end thereof with a discharge orifice therein, a dip tube communicating with the orifice and extending downward from the head to a point adjacent the lower end of the container, conduit means disposed alongside the dip tube and extending within the container from a second point adjacent the upper end of the container and down to the first point, baffle surface means disposed inside the container closely adjacent and beneath the first point, the surface means being generally dish-shaped, and means to generate gas pressure within the container adjacent the upper end thereof to result in the downward movement of gas from the second point through the conduit means to the first point and subsequent fluidization of powder on the baffle and movement of the gas-powder mixture up the dip tube to the orifice.

9. A powder dispenser as claimed in claim 7 wherein the dip tube and conduit means are concentric tubes, the conduit means being defined by the annulus between the tubes.

10. A powder dispenser as claimed in claim 7 wherein the surface means comprises a configuration of the lower surface of the container integral with the bottom wall thereof.

11. A powder dispenser as claimed in claim 7 wherein the baffle surface means is a dish-shaped structure separate from the lower wall of the container and secured to the dip tube by means of an element integral with the baffle surface means and securely engaging the lower end of the dip tube.

12. A powder dispenser as claimed in claim 7 wherein the container is a plastic squeeze bottle.

* * * * *